United States Patent [19]

Pinson

[11] Patent Number: 4,659,036

[45] Date of Patent: Apr. 21, 1987

[54] MISSILE CONTROL SURFACE ACTUATOR SYSTEM

[75] Inventor: George T. Pinson, Huntsville, Ala.

[73] Assignee: The Boeing Company, Seattle, Wash.

[21] Appl. No.: 535,422

[22] Filed: Sep. 26, 1983

[51] Int. Cl.[4] ..... F41G 7/00; F42B 15/02

[52] U.S. Cl. ..... 244/3.22; 244/3.27

[58] Field of Search ..... 244/3.1, 3.21, 3.22, 244/3.24–3.3, 78; 92/121, 122

[56] References Cited

U.S. PATENT DOCUMENTS

| | | | |
|---|---|---|---|
| 2,584,127 | 2/1952 | Harcum et al. | 244/3.21 |
| 3,112,902 | 12/1963 | Kongelbeck | 244/78 X |
| 3,245,352 | 4/1966 | Summers | 244/3.21 |
| 3,276,332 | 10/1966 | Jaffe | 92/122 |
| 3,327,592 | 6/1967 | Wilkinson | 92/122 |
| 3,415,466 | 12/1968 | Poole, Jr. | 244/3.21 |
| 3,695,556 | 10/1972 | Gauzza et al. | 244/3.28 |
| 4,052,024 | 10/1977 | Smith | 244/78 |
| 4,085,909 | 4/1978 | East et al. | 244/3.21 |
| 4,361,073 | 11/1982 | Oelrich et al. | 244/3.21 |

*Primary Examiner*—Harold J. Tudor

[57] ABSTRACT

An actuator system for use in positioning control surfaces on a missile in response to steering commands. The actuator system raising the control surfaces such as missile fins from a retracted position in the missile outwardly to the deployed position and rotating the fins for controlling and steering the missile.

5 Claims, 5 Drawing Figures

MISSILE CONTROL SURFACE ACTUATOR SYSTEM

BACKGROUND OF THE INVENTION

This invention relates to a system for positioning control surfaces on a missile, an airframe and the like and more particularly but not by way of limitation to an actuator system for controlling and steering missile fins in a deployed position on a missile.

Heretofore, there have been different types of systems developed to move and position control surfaces. Primarily these systems were classified as hydraulic, pneumatic, propulsive and electrical actuation. The most typical system is a hydraulic actuator which is in common use on aircraft and missiles and is used when requiring high holding torques.

Pneumatic actuators are also in common use on smaller missiles. A high pressure gas bottle provides a power source for this type of system. A typical dithered bang-bang gas driven actuator is described in U.S. Pat. No. 3,415,466.

Also, other types of high pressure gas systems having positive displacement gear pumps, gas generators operating jet controls and time modulated control valves are described in U.S. Pat. Nos. 4,052,024, 4,085,909 and 4,361,073. None of the above mentioned patents provide the unique features and combinations of structure for accurately deploying and proportionally operating a steering and control system for a missile.

SUMMARY OF THE INVENTION

The subject missile control actuator system is simple in design and provides accurate and finite response and rotating and steering missile fins during missile flight.

Further the actuator system further provides full proportional fin control of the missile fins. Also, the system is designed to move the missile fins from a retracted position in the missile outwardly into a fully deployed position.

The missile control actuator system includes a high pressure gas source and a regulator. A high pressure manifold is connected at one end to the gas source. A plurality of fill lines and vent lines are connected to an actuator housing for receiving and discharging the high pressure gas. The lines are controlled by fill and vent valves. The actuator housing includes actuator vanes connected to an actuator shaft. The vanes are rotated in the housing thereby rotating the actuator shaft which is in turn connected to the missile fin.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1A:
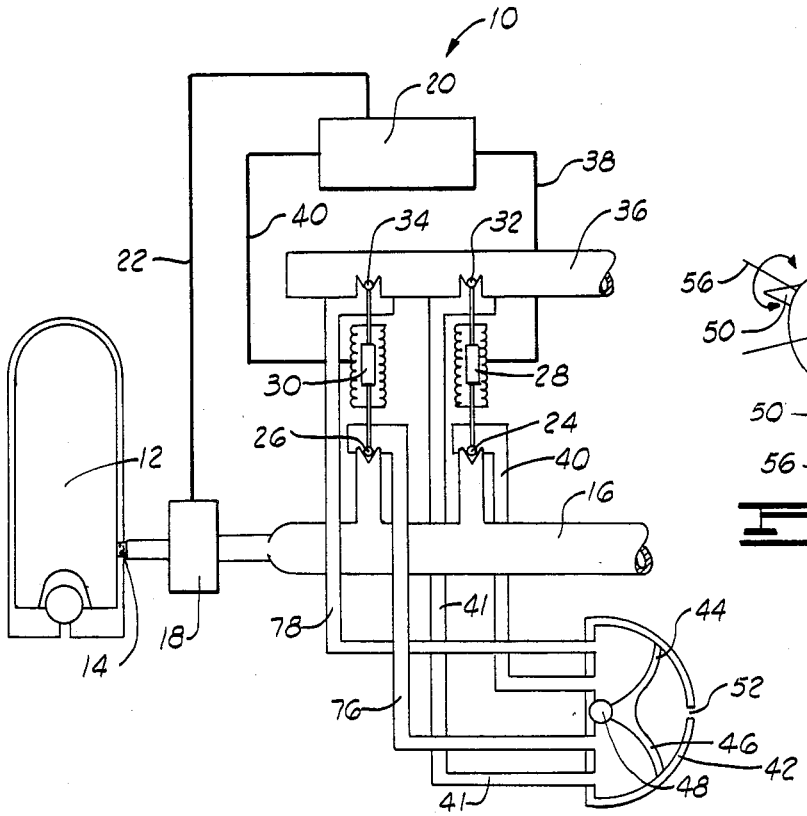
FIG. 1A illustrates a schematic of the surface actuator system.

In FIG. 1A the actuator system for use in positioning control surfaces on a missile in response to the steering commands is designated by general reference numeral 10. The system 10 includes a pressure source 12 which consists of either stored hot gas, cold gas or a gas generator which is used to drive the overall system 10. Where necessary the gas is received through a filter 14 disposed at one end of a high pressure manifold 16. Also connected to the manifold 16 is a regulator 18 which is controlled by an electrical control system 20 connected to the regulator 18 via lead 22.

Also connected to the pressure manifold 16 is a first fill valve 24 and a second fill valve 26. The fill valve 24 and 26 may be part of a two-way valve 28 and 30 with the opposite ends of the valves 28 and 30 including a first vent valve 32 and a second vent valve 34. The valves 32 and 34 are connected to a vent line 36. The vent line 36 is optional and could be eliminated with the gases vented into the atmosphere if so desired. The electrical control system 20 controls the valves 28 and 30 via leads 38 and 40.

In operation the fill valve 24 is open permitting high pressure gas from the manifold 16 to pass into one end of a first fill line 40. The gas enters through the opposite end of the fill line 40 into an actuator housing 42 and expands against an actuator vane 44. At the same time, the vent valve 32 is opened thereby permitting gas against a lower actuator vane 46 to be released and the gas is vented through the vent tube 36 via a first vent line 41. The actuator vanes 44 and 46 are attached to an actuator shaft 48. Movement of the actuator vanes 44 and 46 result in motion about the shaft 48 which is used to drive a missile fin 50 shown in FIGS. 2, 3 and 4. It should be noted that the manifold 16 is extended to the right for providing gas to identical systems 10 for controlling the other missile fins 50.

Figure 1B:
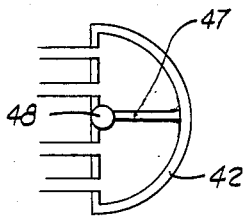
FIG. 1B illustrates an actuator housing with a single vane system.

To prevent pressure build up in the actuator housing 42, a vent 52 is provided for pressure release. It should be noted that to the two actuator vanes 44 and 46 are not necessarily required and a single vane system could work equally well with less costly fabrication. In this case, when using a single vane, the vent 52 would not be required. A single vane system with a single vane 47 is shown in FIG. 1B.

Figure 2:
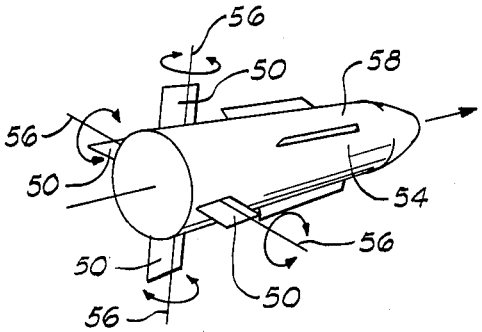
FIG. 2 illustrates the rotation of missile fins about its rotational axis mounted at the rear of a missile.

FIG. 2 illustrates a missile 54 having a plurality of fins 50 shown rotating about rotational axis 56. It should be noted by complete control of the rotation of the actuator shaft 48 using the high pressure gas source 12, a full proportional fin control system is provided.

Figure 3:
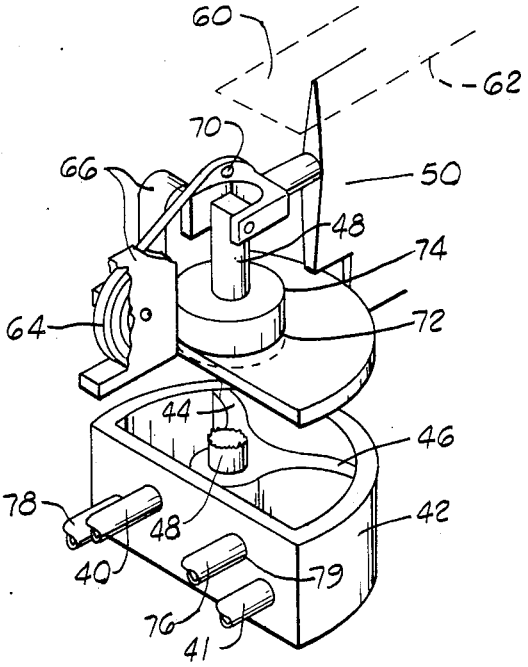
FIG. 3 illustrates the retracted position of a missile fin connected to the actuator housing of the system.
Figure 4:
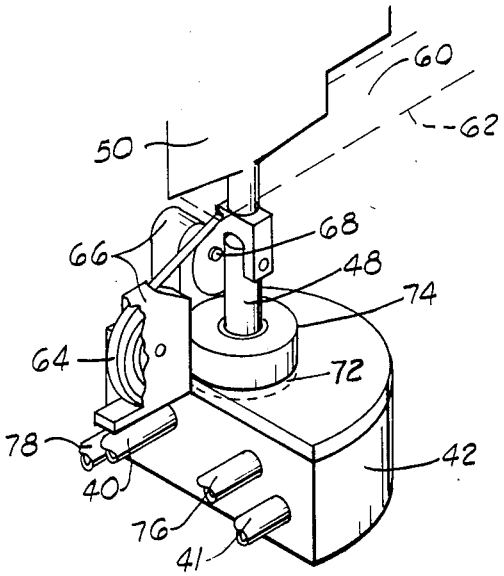
FIG. 4 illustrates the deployed or raised position of the missile fin.

In FIGS. 3 and 4 the deployment of one of the missile fins 50 is illustrated. The fin 50, in a retracted position in FIG. 3 is positioned below the outside surface of a missile skin 58 shown in FIG. 2 with an opening 60 in the missile skin 58 illustrated by dotted lines 62. The fin 50 is deployed using a coil spring 64. The spring 64 is located inside a spring housing 66. Upon deployment the fin 50 is locked into position using a locking pin 68 which fits into an aperture 70 in the side of a yoke 72. The yoke 72 is part of the fin 50 used in mounting the fin 50 to the shaft 48. Also in FIG. 3 the top of the housing 42 has been raised to expose the vanes 44 and 46 connected to the shaft 48.

The fin 50 is locked by the locking pin 68 into its operating position against the spring housing 66. The spring housing 66 is fixed to the actuator shaft 48. The actuator shaft 48 is attached to the fin 50 by bearings 72 shown in dotted lines. The actuator shaft 48 and vanes 44 and 46 are attached to the housing 42 through bearings 72. Actuator rotation thereby results in the rotation of the fins 50. The amount of motion, i.e. electrical control system feedback to the electrical control system 20 is obtained by a potentiometer 74 or by any other type of position or angular position measuring transducer.

The two-way valves 28 and 30 shown in FIG. 1 can be controlled in a partial or fully open position. Also, conventional valves can be used to meet similar design requirements. From reviewing the valves 28 and 30 it can be seen, in operating valve 28 when the first fill valve 24 and the first vent valve 32 are opened, high pressure gas is received in the top of the actuator housing 42 with the vane 44 rotating in a clockwise direction and gas is discharged from the bottom of the housing through first vent line 41. By operating the second two-way valve 30, the second fill valve 26 and the second vent valve 34 are opened. High pressure gas to be received via a second fill line 76 in the bottom of the actuator housing 42 thereby rotating the vane 46 in a counter clockwise direction. At this time gas is exhausted out the top of the housing 42 via a second vent line 78 connected to the vent tube 36.

Changes may be made in the construction and arrangement of the parts or elements of the embodiments as described herein without departing from the spirit or scope of the invention defined in the following claims.

What is claimed is:

1. A missile control surface actuator system for controlling and steering fins on a missile, the actuator system comprising:

a high pressure gas source;

a high pressure manifold connected to the gas source;

a pressure regulator connected between the high pressure source and the high pressure manifold for regulating the amount of high pressure gas to the manifold;

a first and second fill line connected at one end to the manifold;

a first and second fill valve connected in the first and second fill lines for controlling the amount of gas received from the manifold the first and second fill valves each operating independently of each other, an actuator housing connected to the other end of the first and second fill lines, the actuator having an actuator vane connected to an actuator shaft, the vane rotating the shaft when gas is received in the housing, the shaft is directly connected to one of the missile's fins for controlling and steering the missile;

a first and second vent valve connected to a first and second vent lines, the first and second vent lines connected to the actuator housing for discharging gas from the housing; and an electrical control system connected to the first and second fill valves, first and second vent valves and the regulator for opening and closing the valves and controlling the amount of gas received and discharged from the actuator housing.

2. The system as described in claim 1 wherein the first fill valve and the first vent valve is a two-way valve and the second fill valve and the second vent valve is a two way valve.

3. The system as described in claim 1 wherein the first fill line is received in the actuator housing on one side of the actuator vane, the second fill line is received in the actuator housing on the opposite side of the actuator vane and the first vent line is received in the actuator housing on the opposite side of the actuator vane from the second vent line received in the actuator housing.

4. The system as described in claim 1 further including spring biasing means mounted on the actuator housing for urging the missile fin outwardly from a retracted position to deployed position.

5. A missile control surface actuator system for controlling and steering fins on a missile, the actuator system comprising:

a high pressure gas source;

a high pressure manifold connected to the gas source;

a pressure regulator connected between the high pressure source and the high pressure manifold for regulating the amount of high pressure gas to the manifold;

a first and second fill line connected at one end to the manifold;

a first and second fill valve connected in the first and second fill lines for controlling the amount of gas received from the manifold;

an actuator housing connected to the other end of the first and second fill lines, the actuator having an actuator vane connected to an actuator shaft, the vane rotating the shaft when gas is received in the housing, the shaft is directly to one of the missile's fins for controlling and steering the missile, a first and second vent valve connected to a first and second vent lines, the first and second vent lines connected to the actuator housing for discharging gas from the housing, the first fill valve and first vent valve is a two-way valve and the second fill valve and second vent valve is a two-way valve, the valves each operating independently of each other;

an electrical control system connected to the first and second fill valves, the first and second vent valves and the regulator for opening and closing the valves and controlling the amount of gas received and discharged from the actuator housing; and a potentiometer attached to the actuator shaft and the control system for providing feedback of shaft rotation and thus fin rotation to the control system.

* * * * *